US010767350B2

(12) United States Patent
Motomura

(10) Patent No.: US 10,767,350 B2
(45) Date of Patent: Sep. 8, 2020

(54) ATTACHMENT PIN ASSEMBLY

(71) Applicant: SEIKI KOEI CORPORATION, Higashiosaka-shi, Osaka (JP)

(72) Inventor: Yasunori Motomura, Higashiosaka (JP)

(73) Assignee: SEIKI KOEI CORPORATION, Higashiosaka-Shi, Osaka (JP)

( * ) Notice: Subject to any disclaimer, the term of this patent is extended or adjusted under 35 U.S.C. 154(b) by 15 days.

(21) Appl. No.: 16/225,372

(22) Filed: Dec. 19, 2018

(65) Prior Publication Data

US 2019/0234051 A1 Aug. 1, 2019

(30) Foreign Application Priority Data

Feb. 1, 2018 (JP) ..... 2018-016766

(51) Int. Cl.
*E02F 9/28* (2006.01)
*E02F 3/40* (2006.01)
*E02F 3/60* (2006.01)

(52) U.S. Cl.
CPC ..... *E02F 9/2833* (2013.01); *E02F 9/2825* (2013.01); *E02F 9/2858* (2013.01); *E02F 3/40* (2013.01); *E02F 3/60* (2013.01); *E02F 9/2875* (2013.01)

(58) Field of Classification Search
CPC ..... E02F 9/2833; E02F 9/2825; E02F 9/2858; E02F 9/2875; E02F 3/60; E02F 9/2808; E02F 3/40
USPC ..... 37/456
See application file for complete search history.

(56) References Cited

U.S. PATENT DOCUMENTS 1,808,311 A * 6/1931 Madonna ..... E02F 9/2825 37/456
5,077,918 A * 1/1992 Garman ..... E02F 9/2808 172/701.3
6,439,796 B1 * 8/2002 Ruvang et al. ..... E02F 9/2841 37/455
7,603,799 B2 * 10/2009 Campomanes ..... E02F 9/2841 37/456

(Continued)

FOREIGN PATENT DOCUMENTS

JP 2011-246974 12/2011
JP 2017-115330 6/2017
WO 2011/125794 10/2011

OTHER PUBLICATIONS

Notification of Reasons for Refusal issued by JPO and English translation for JP 2018-016766, dated Feb. 26, 2018, 6 pages.

*Primary Examiner* — Tara Mayo-Pinnock
(74) *Attorney, Agent, or Firm* — Nixon & Vanderhye P.C.

(57) ABSTRACT

An attachment pin assembly includes a first pin body, a second pin body, and a bolt for fastening and fixing the first pin body and the second pin body to each other. The first pin body has a first shaft portion and a flange portion formed at an end of the first shaft portion. The second pin body has a second shaft portion. The bolt is inserted into the flange portion and the first shaft portion of the first pin body and the second shaft portion of the second pin body. Moreover, a housing recessed portion for housing a head of the bolt is formed at the first pin body, and a bottom surface of the housing recessed portion is arranged on a tip end side of the first shaft portion as a second pin body side with respect to a seating surface of the flange portion.

2 Claims, 11 Drawing Sheets

(56) References Cited

U.S. PATENT DOCUMENTS

| | | | | |
|---|---|---|---|---|
| 2001/0052196 | A1* | 12/2001 | Pippins | E02F 9/2833 37/456 |
| 2003/0140531 | A1* | 7/2003 | Pippins | E02F 9/2825 37/456 |
| 2006/0059732 | A1 | 3/2006 | Clendenning et al. | |
| 2009/0044435 | A1* | 2/2009 | Bentley | E02F 9/2833 37/456 |
| 2012/0222336 | A1 | 9/2012 | Itou et al. | |
| 2012/0304508 | A1* | 12/2012 | Guimaraes et al. | E02F 9/2825 37/457 |
| 2018/0163377 | A1 | 6/2018 | Motomura | |
| 2019/0234052 | A1* | 8/2019 | Motomura | E02F 9/2858 |
| 2020/0032491 | A1* | 1/2020 | Motomura | E02F 9/2825 |

* cited by examiner

ATTACHMENT PIN ASSEMBLY

This claims priority to JP Patent Application No. 2018-016766 filed 1 Feb. 2018, the entire contents of which is hereby incorporated by reference.

TECHNICAL FIELD

The present disclosure relates to an attachment pin assembly for attaching a drilling tool to an adaptor of an operating machine.

BACKGROUND ART

An operating machine such as a power shovel includes an operating portion such as a bucket. Various drilling tools are attached to the operating portion. For example, multiple adaptors are, at predetermined intervals, fixed to a tip end portion of the bucket of the power shovel for drilling. Moreover, teeth as the drilling tools are each attached to the adaptors. The teeth are abraded or damaged in a drilling process, and therefore, are replaced as necessary.

Patent Literature 1 discloses such an attachment pin assembly for attaching the tooth to the adaptor of the bucket.

A pair of first through-holes is formed at the tooth described in Patent Literature 1, and on the other hand, a second through-hole is formed at the adaptor. In an attachment state in which the adaptor is inserted into the tooth in contact with the tooth, the first through-holes and the second through-hole are arranged to penetrate the tooth and the adaptor. Moreover, in the tooth attachment state, the centers of the first through-holes and the second through-hole are coincident with each other, and are in a concentric state.

The attachment pin assembly of Patent Literature 1 includes a circular columnar pin body inserted into the first through-hole and the second through-hole, a cylindrical bush arranged at an end portion of the pin body in the first through-hole, and a bolt and a washer provided at each end of the pin body to prevent detachment of the bush from such an end of the pin body. A head of the bolt laterally protrudes from the end portion of the pin body. The tooth is thickly formed in a longitudinal direction of the pin body to surround the head of the bolt. Thus, the head of the bolt receives less impact from a rock, a rubble, etc. upon use of the tooth.

CITATION LIST

Patent Literature

PATENT LITERATURE 1: International Patent Application Publication No. 2011/125794

SUMMARY OF THE INVENTION

Problems to be Solved by the Invention

However, in the attachment pin assembly of Patent Literature 1, the head of the bolt laterally protrudes from the end portion of the pin body, and the entirety of the head of the bolt is exposed in the first through-hole. That is, a great clearance is present between a side surface of the head of the bolt and an inner wall surface of the tooth forming the first through-hole, and for this reason, there is still a probability that the head of the bolt is lost due to an impact on the head of the bolt. As a result, the tooth drops out of the adaptor.

Further, in Patent Literature 1, it is configured such that the tooth is thickly formed in the longitudinal direction of the pin body to surround the head of the bolt by part of the tooth, and therefore, the weight of the tooth is inevitably increased.

The present disclosure has been made in view of the above-described points, and is intended to suppress an increase in the weight of a drilling tool while properly protecting a head of a bolt forming an attachment pin assembly.

Solution to the Problems

An attachment pin assembly of the present disclosure attaches and fixes a drilling tool to an adaptor of an operating machine in a drilling tool attachment state in which the adaptor is inserted into the drilling tool in contact with the drilling tool. The drilling tool is provided with a pair of first through-holes, and the adaptor is provided with a second through-hole. The pair of first through-holes and the second through-hole are arranged to penetrate the drilling tool and the adaptor in the drilling tool attachment state. The attachment pin assembly 10 includes a first pin body including a first shaft portion inserted into one of the first through-holes and the second through-hole from a first side portion of the drilling tool and a flange portion formed at an end of the first shaft portion; a second pin body having a second shaft portion inserted into the other first through-hole and the second through-hole from a second side portion of the drilling tool on the opposite side of the first side portion; and a bolt inserted into the flange portion and the first shaft portion of the first pin body and the second shaft portion of the second pin body to fasten and fix the first pin body and the second pin body to each other. A housing recessed portion for housing a head of the bolt inside the first through-hole is formed at the first pin body, and a bottom surface of the housing recessed portion is arranged on a tip end side of the first shaft portion as a second pin body side with respect to a seating surface of the flange portion.

Effects of the Invention

According to the present disclosure, an increase in the weight of the drilling tool can be suppressed while the head of the bolt forming the attachment pin assembly can be properly protected.

DESCRIPTION OF THE EMBODIMENTS

Hereinafter, embodiments will be described in detail with reference to the drawings. Note that the present disclosure is not limited to the embodiments below.

First Embodiment

Figure 1:
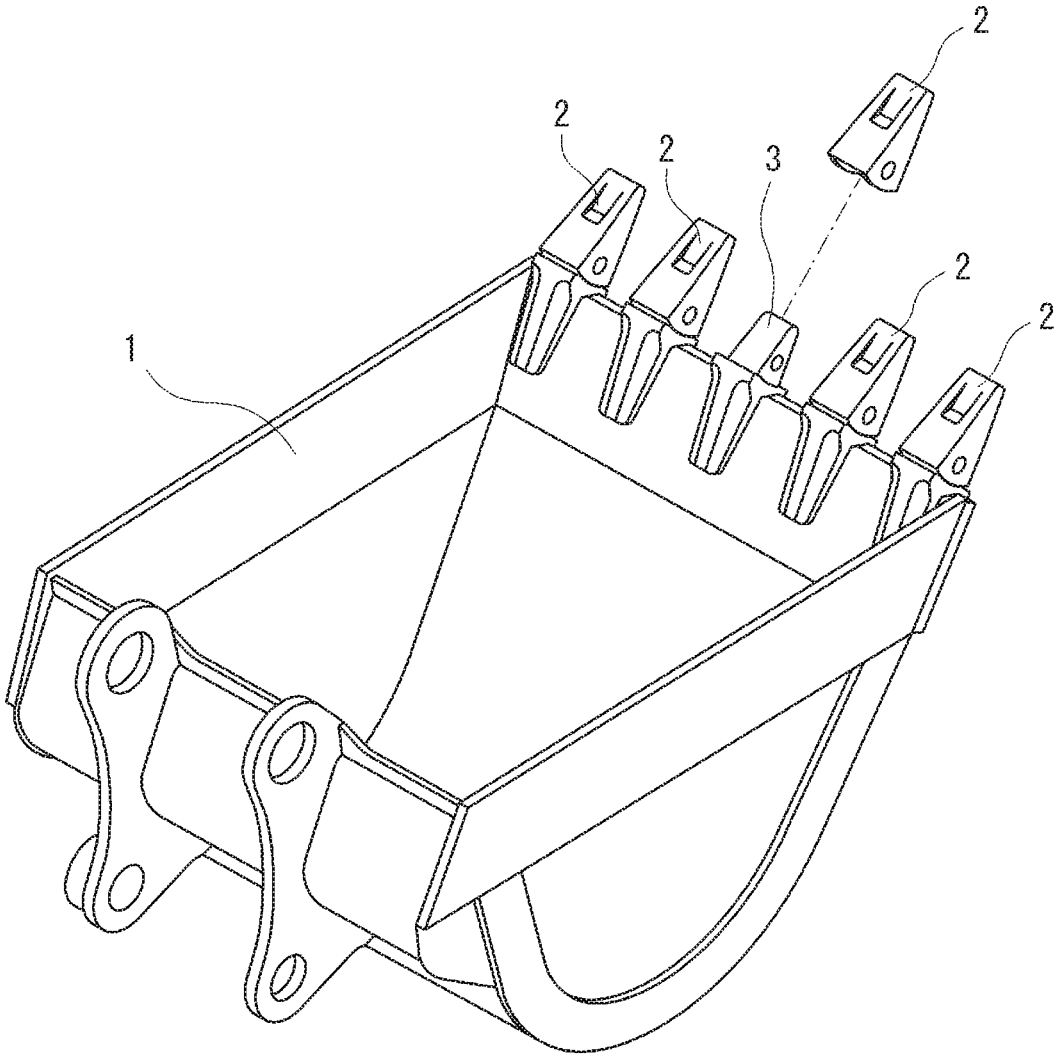
FIG. 1 is a perspective view of a tooth attachment structure of a bucket in a first embodiment.

FIG. 1 illustrates a tooth attachment structure of a bucket 1 in the present embodiment.

Although not shown in the figure, the bucket (an operating portion) 1 is mounted on an arm of a power shovel (an operating machine). As illustrated in FIG. 1, multiple adaptors 3 are fixed to a tip end portion of the bucket 1 for drilling. Teeth 2 as drilling tools are each attached to the adaptors 3. The teeth 2 are abraded or damaged in a drilling process, and therefore, are replaced as necessary.

Figure 2:
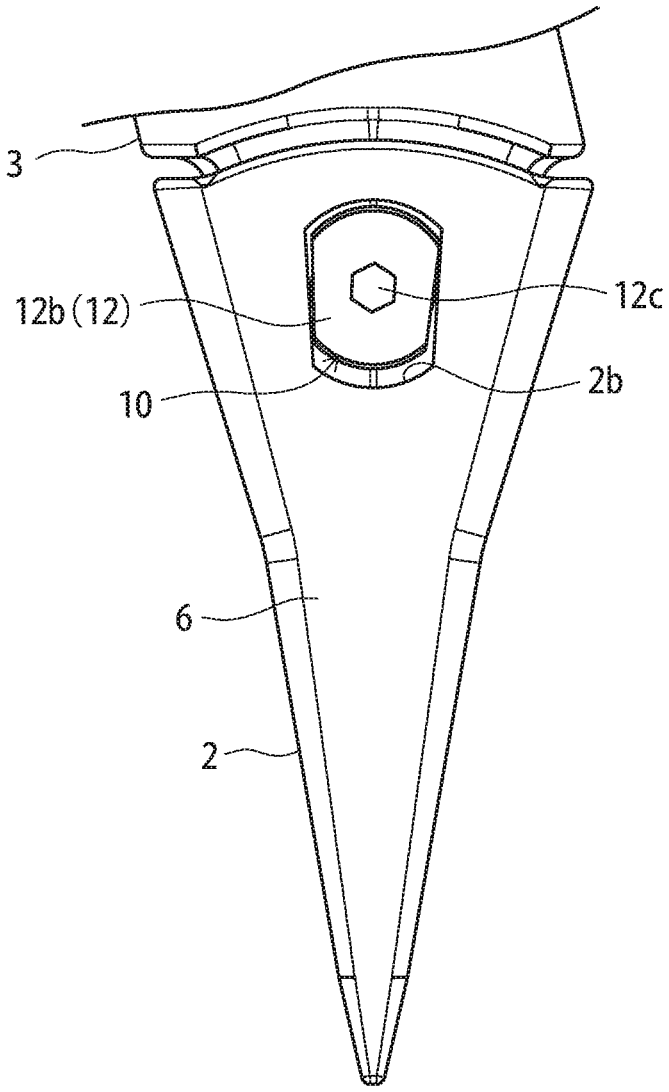
FIG. 2 is a side view of a second side portion of a tooth to which an attachment pin assembly is attached.
Figure 3:
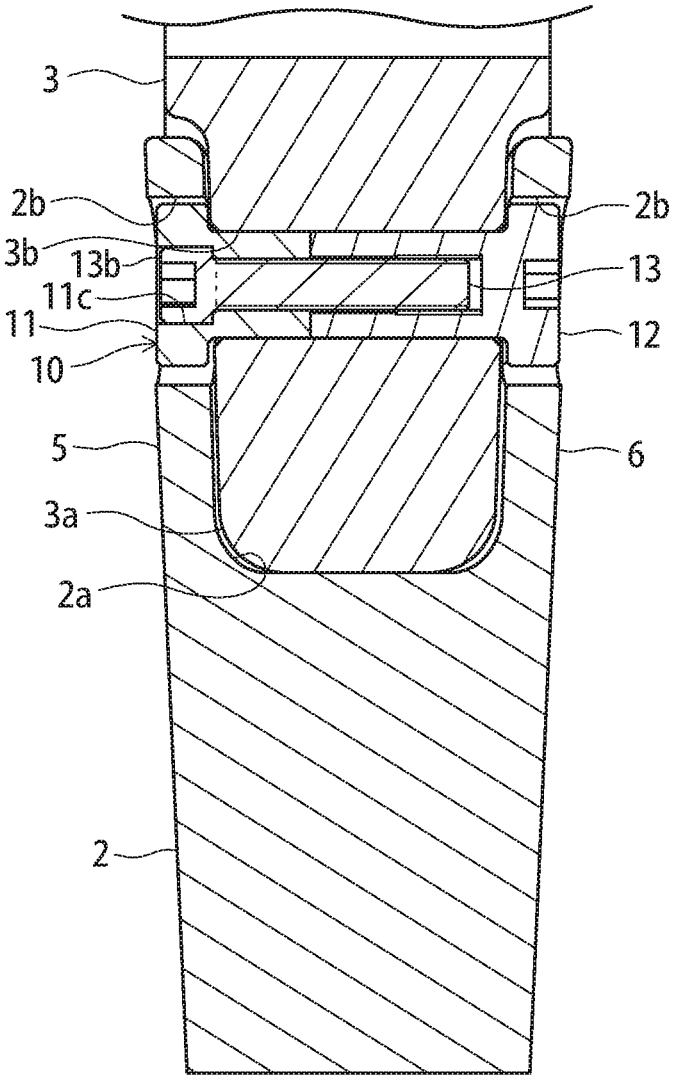
FIG. 3 is a sectional view of the tooth attachment structure to which the attachment pin assembly is attached in the first embodiment.
Figure 4:
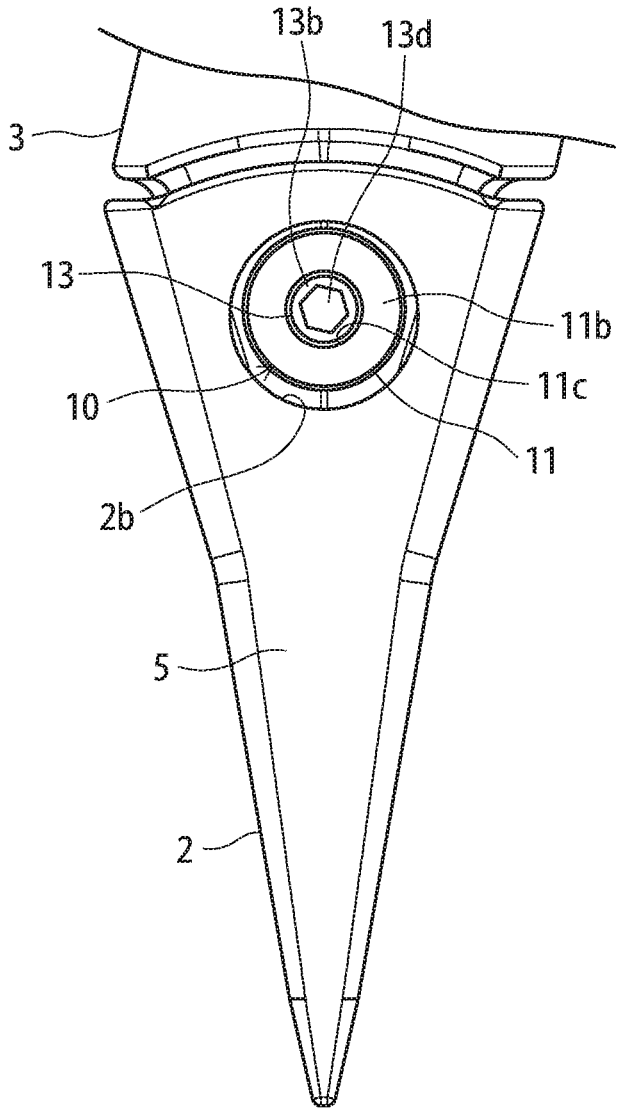
FIG. 4 is a side view of a first side portion of the tooth to which the attachment pin assembly is attached.

FIGS. 2 to 4 illustrate a state of attachment of the tooth 2 to the adaptor 3. The tooth attachment structure in the present embodiment is, as illustrated in FIG. 3, a structure for attaching the tooth 2 to the bucket 1. The tooth attachment structure includes the tooth 2, the adaptor 3, and an attachment pin assembly 10.

The tooth 2 is a claw-shaped member attached to the drilling tip end portion of the bucket 1 for performing drilling with the bucket 1, and as illustrated in FIGS. 2 and 4, has a wedge-shaped outer shape narrowed toward a tip end thereof. As illustrated in FIG. 3, the tooth 2 has a recessed portion 2*a* and a pair of first through-holes 2*b*.

The recessed portion 2*a* is, in the tooth 2, formed from a back end opening toward the tip end of the tooth 2. An insertion portion 3*a* of the adaptor 3 as described later is inserted into the recessed portion 2*a*. As in the outer shape of the tooth 2, the recessed portion 2*a* has a wedge shape whose inner width is narrowed toward a tip end thereof.

One first through-hole 2*b* penetrates the tooth 2 from a first side portion 5 thereof to the recessed portion 2*a*, and the other first through-hole 2*b* penetrates the tooth 2 from a second side portion 6 on the opposite side of the first side portion 5 to the recessed portion 2*a*. That is, the first through-holes 2*b* are each formed at right and left side wall portions of the tooth 2. The first through-holes 2*b* are formed along a direction perpendicular to a longitudinal direction of the tooth 2 (a direction connecting a back end and the tip end of the tooth 2). The later-described attachment pin assembly 10 is inserted into the first through-holes 2*b*.

As illustrated in FIG. 4, the first through-hole 2*b* of the first side portion 5 is formed such that the first side portion 5 opens in a circular shape. On the other hand, as illustrated in FIG. 2, the first through-hole 2*b* of the second side portion 6 is formed such that the second side portion 6 opens in a long hole shape extending in the longitudinal direction of the tooth 2. That is, the long hole-shaped opening forming the first through-hole 2*b* of the second side portion 6 includes two flat surfaces extending in the longitudinal direction of the tooth 2 and facing each other, and concave surfaces connecting these two flat surfaces into a closed shape.

As illustrated in FIG. 1, the multiple adaptors 3 are provided at predetermined intervals at the tip end portion of the bucket 1, and are fixed to the tip end portion of the bucket 1 by welding etc. The above-described teeth 2 are each attached to the adaptors 3. As illustrated in FIG. 3, the adaptor 3 has the insertion portion 3*a* and a second through-hole 3*b*.

The insertion portion 3*a* is formed at a tip end of the adaptor 3, and is formed in a wedge shape in accordance with the recessed shape of the recessed portion 2*a* formed in the tooth 2. As illustrated in FIG. 3, the insertion portion 3*a* is inserted into the recessed portion 2*a* in the tooth 2, and an outer wall surface of the insertion portion 3*a* contacts an inner wall surface of the recessed portion 2*a*. In this manner, an attachment state of the tooth 2 is brought.

The second through-hole 3*b* penetrates the insertion portion 3*a* of the adaptor 3 in a width direction thereof (a right-to-left direction in FIG. 3). As in the above-described first through-hole 2*b*, the later-described attachment pin assembly 10 is inserted into the second through-hole 3*b*.

Moreover, as illustrated in FIG. 3, in the attachment state of the tooth 2, the pair of first through-holes 2*b* and the second through-hole 3*b* are arranged to penetrate the tooth 2 and the adaptor 3. Further, in the attachment state of the tooth 2, a side surface of the adaptor 3 at the periphery of the second through-hole 3*b* is exposed in the first through-holes 2*b* of the tooth 2.

FIGS. 5 to 8 illustrate the attachment pin assembly 10 in the first embodiment. The attachment pin assembly 10 is a member for attaching the tooth 2 to the adaptor 3, and is for preventing the tooth 2 from dropping out of the adaptor 3. As illustrated in FIG. 2, the attachment pin assembly 10 is, in the attachment state of the tooth 2, inserted into the first through-holes 2*b* of the tooth 2 and the second through-hole 3*b* of the adaptor 3.

As illustrated in FIGS. 5 to 8, the attachment pin assembly 10 includes a first pin body 11, a second pin body 12, and a bolt 13. The first pin body 11, the second pin body 12, and the bolt 13 are each made of metal.

The first pin body 11 is inserted into the first through-hole 2*b* and the second through-hole 3*b* from the first side portion 5 of the tooth 2. On the other hand, the second pin body 12 is inserted into the first through-hole 2*b* and the second through-hole 3*b* from the second side portion 6 of the tooth 2 on the opposite side of the first side portion 5.

The bolt 13 has a shaft 13*a* and a head 13*b* integrally formed with an end of the shaft 13*a*. An external thread portion 13*c* is formed at a portion of the shaft 13*a* extending from a substantially center position to a tip end. A hexagonal hole 13*d* is formed at the head 13*b*. The bolt 13 is inserted into the first pin body 11 and the second pin body 12, thereby fastening and fixing the first pin body 11 and the second pin body 12 to each other.

The first pin body 11 has a circular columnar first shaft portion 11*a* and a discoid first flange portion 11*b* formed at an end of the first shaft portion 11*a*. A first bolt hole 11*d* extending in an axial direction of the first shaft portion 11*a* is formed to penetrate the first shaft portion 11*a*. A housing recessed portion 11*c* for housing the head 13*b* of the bolt 13 is formed at the first flange portion 11*b*. The inner diameter of the housing recessed portion 11*c* is slightly larger than the outer diameter of the head 13*b* of the bolt 13. The housing recessed portion 11*c* communicates with the first bolt hole 11*d*.

The second pin body 12 has a circular columnar second shaft portion 12*a* and a plate-shaped second flange portion 12*b* formed at an end of the second shaft portion 12*a*. A second bolt hole 12*d* extending in an axial direction of the second shaft portion 12*a* is formed at the second shaft portion 12*a*. An internal thread portion 12*e* into which the external thread portion 13*c* of the bolt 13 is to be screwed is formed at a far-side portion of the second bolt hole 12*d*. The second flange portion 12*b* is formed in a plate shape, and includes two flat surfaces 15 extending obliquely and two arc surfaces 16 connecting these two flat surfaces 15. That is, a distance between two flat surfaces 15 gradually decreases from the lower arc surface 16 to the upper arc surface 16 as viewed in FIG. 5. Moreover, a hexagonal hole 12*c* is formed at the center of the second flange portion 12*b*.

Figure 5:
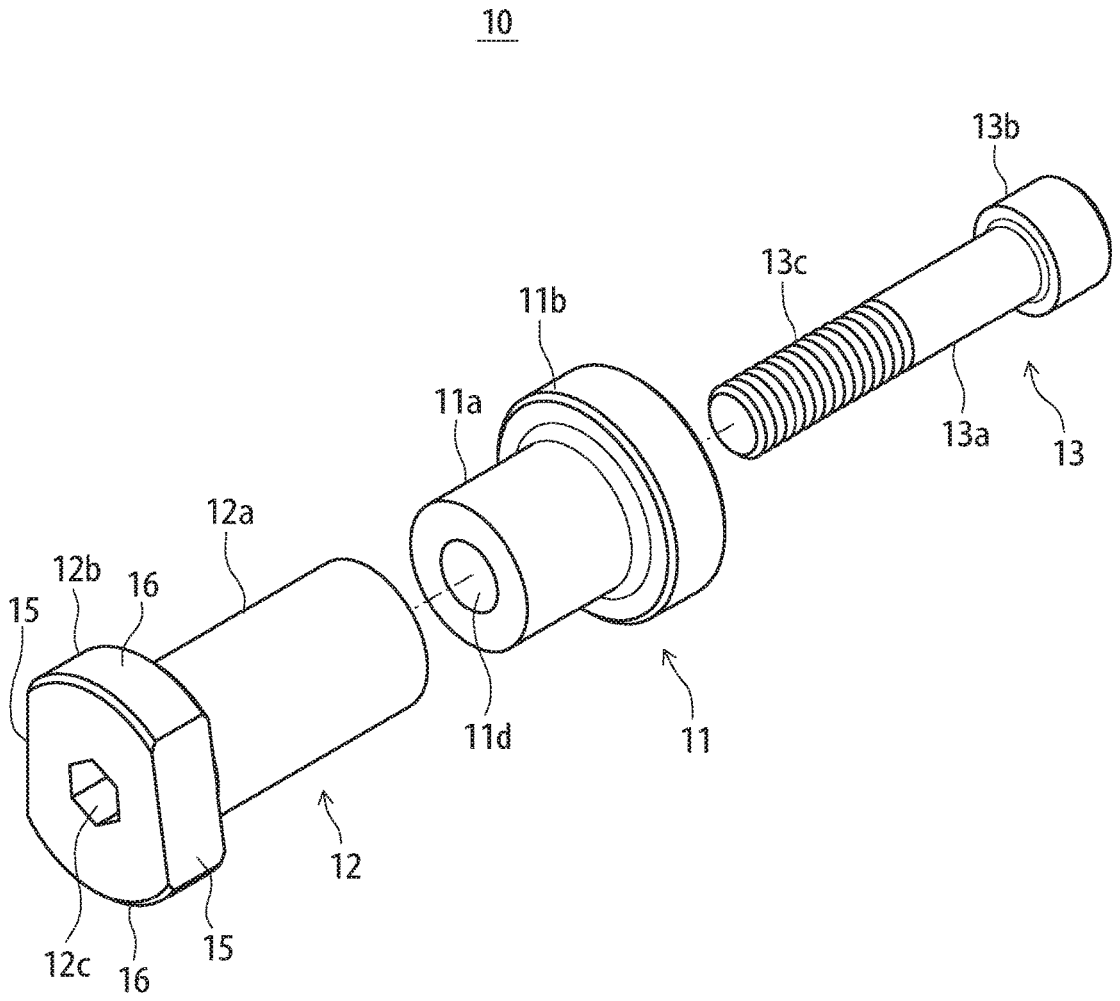
FIG. 5 is an exploded perspective view of a structure of the attachment pin assembly in the first embodiment.
Figure 6:
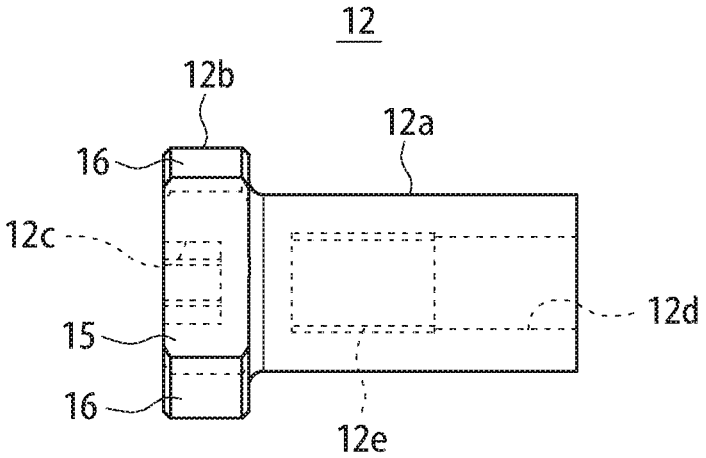
FIG. 6 is a front view of a second pin body in the first embodiment.
Figure 7:
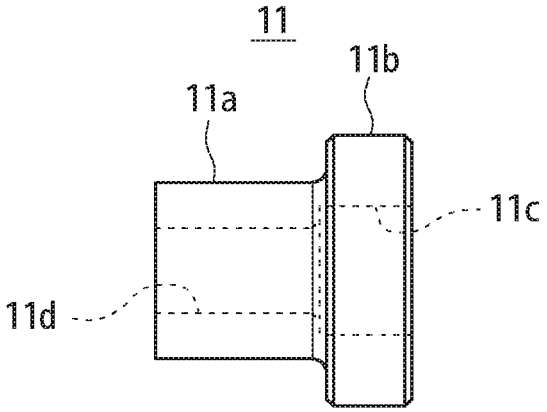
FIG. 7 is a front view of a first pin body in the first embodiment.
Figure 8:
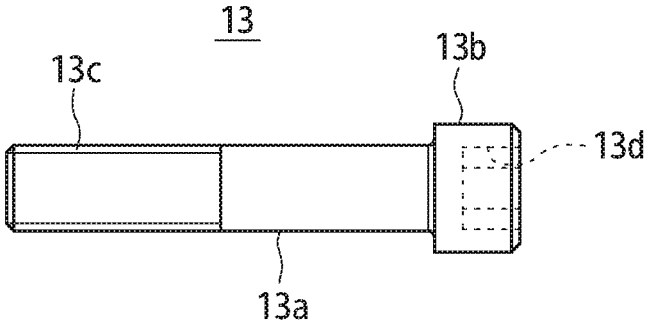
FIG. 8 is a front view of a bolt in the first embodiment.

The first shaft portion 11*a* of the first pin body 11 and the second shaft portion 12*a* of the second pin body 12 have the same outer diameter size. The outer diameters of the first shaft portion 11*a* and the second shaft portion 12*a* are slightly smaller than the inner diameter of the second through-hole 3*b* of the adaptor 3. Moreover, as illustrated in FIGS. 5 to 7, a tip end of the first pin body 11 (i.e., a tip end of the first shaft portion 11*a*) is formed in a planar shape across the substantially entirety of such a tip end, except for the first bolt hole 11*d*. A tip end of the second pin body 12 (i.e., a tip end of the second shaft portion 12*a*) is formed in a planar shape across the substantially entirety of such a tip end, except for the second bolt hole 12*d*. Moreover, as illustrated in FIG. 3, the first pin body 11 and the second pin body 12 are fastened and fixed with the bolt 13 in a state in which these planar tip ends contact each other.

Figure 9:
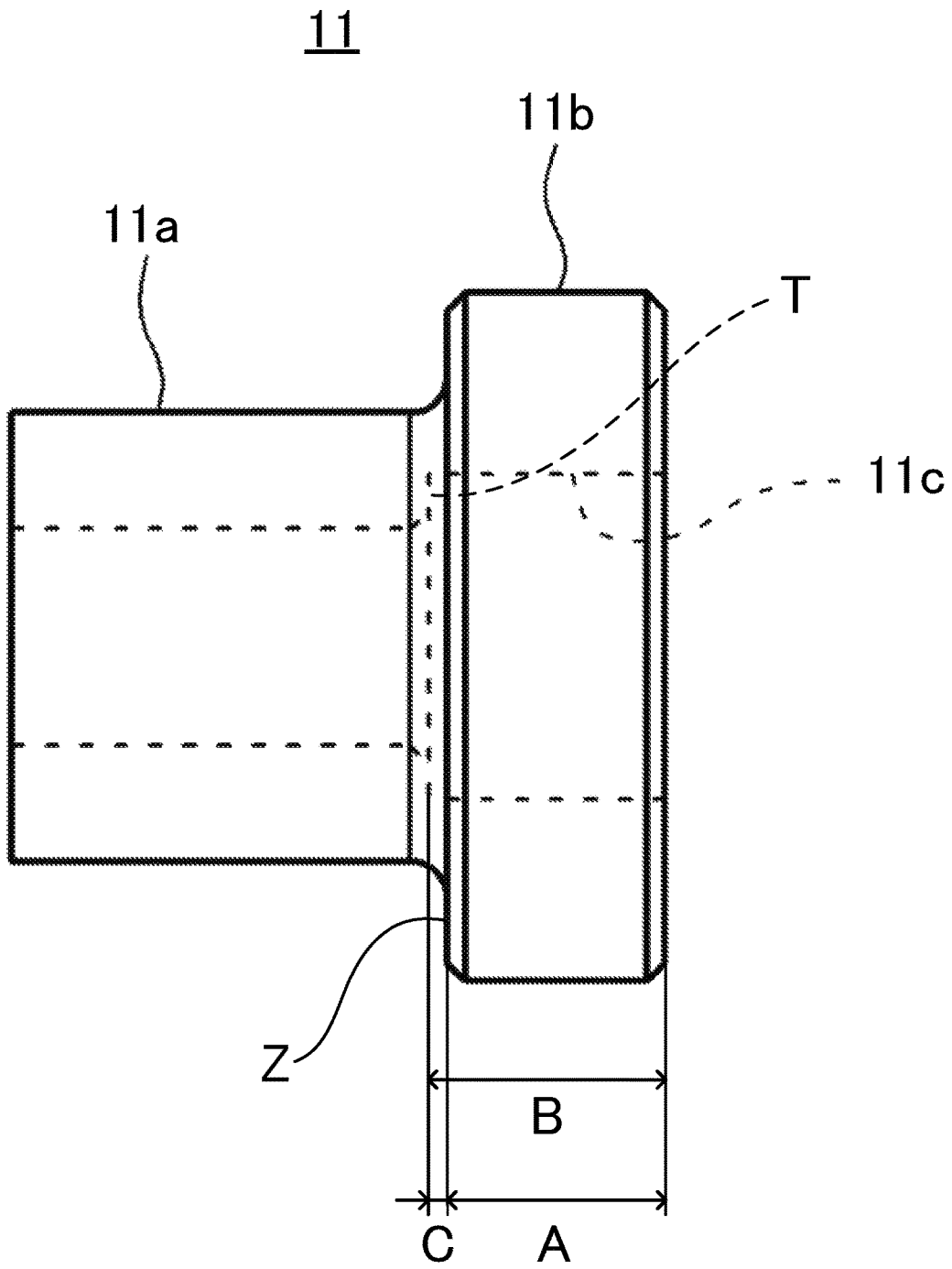
FIG. 9 is an enlarged front view of the first pin body in the first embodiment.

As illustrated in FIG. 9, a bottom surface T of the housing recessed portion 11*c* formed at the first pin body 11 is arranged on a tip end side (i.e., the left side as viewed in FIG. 9) of the first shaft portion 11*a* as a second pin body 12 side with respect to a seating surface Z of the first flange portion 11*b*. Thus, the thickness A of the first flange portion 11*b* is a length obtained in such a manner that a distance C between the bottom surface T of the housing recessed portion 11*c* and the seating surface Z of the first flange portion 11*b* is subtracted from the depth B of the housing recessed portion 11*c* (A=B−C).

In the case of attaching and fixing the tooth 2 to the adaptor 3 of the operating machine, the first pin body 11 is inserted into the first through-hole 2*b* and the second through-hole 3*b* from the first side portion 5 of the tooth 2 with the tooth 2 being attached to the adaptor 3. Further, the second pin body 12 is inserted into the first through-hole 2*b* and the second through-hole 3*b* from the second side portion 6 of the tooth 2. At this point, the first shaft portion 11*a* of the first pin body 11 and the second shaft portion 12*a* of the second pin body 12 are housed in the second through-hole 3*b* with the tip ends of the first shaft portion 11*a* and the second shaft portion 12*a* contacting each other. The first flange portion 11*b* of the first pin body 11 and the second flange portion 12*b* of the second pin body 12 are each housed in the first through-holes 2*b*.

Subsequently, the shaft 13*a* of the bolt 13 is inserted into the first bolt hole 11*d* of the first pin body 11, and is screwed by a hexagonal wrench (not shown) inserted into the hexagonal hole 13*d*. Accordingly, the external thread portion 13*c* of the bolt 13 is screwed into the internal thread portion 12*e* of the second pin body 12. That is, the bolt 13 is screwed into the second pin body 12 without being screwed into the first pin body 11.

At this point, as illustrated in FIG. 2, the second flange portion 12*b* including two flat surfaces 15 and two arc surfaces 16 as side surfaces is locked at an inner wall surface of the tooth 2 forming the first through-hole 2*b*. Thus, upon screwing with the bolt 13, the second flange portion 12*b* functions as a rotation stopper of the second pin body 12.

Then, in a state in which the first pin body 11 and the second pin body 12 are fastened and fixed with the bolt 13, the head 13*b* of the bolt 13 is housed in the housing recessed portion 11*c* of the first pin body 11 inside the first through-hole 2*b* of the tooth 2. The head 13*b* of the bolt 13 is housed in the housing recessed portion 11*c* without protruding from the first flange portion 11*b* of the first pin body 11.

Thus, according to the first embodiment, the first pin body 11 inserted into the first through-hole 2*b* and the second through-hole 3*b* from the first side portion 5 of the tooth 2 and the second pin body 12 inserted into the first through-hole 2*b* and the second through-hole 3*b* from the second side portion 6 of the tooth 2 are fastened and fixed to each other with the bolt 13. Thus, the tooth 2 can be properly attached and fixed to the adaptor 3 by the attachment pin assembly 10. Moreover, the tooth 2 can be easily detached from the adaptor 3 by steps in reverse order of attachment fixing steps.

The attachment pin assembly includes, as pin bodies, two members of the first and second pin bodies. In addition, the first pin body and the second pin body are fastened and fixed with the bolt in a state in which the flat tip ends thereof contact each other. That is, the tip ends (i.e., the tip end of the first shaft portion 11*a* and the tip end of the second shaft portion 12*a*) of the first pin body and the second pin body are not in such recessed and raised shapes that these tip ends are fitted each other.

If the tip ends of the first pin body and the second pin body are in such recessed and raised shapes that these tip ends are fitted each other, the inner diameter of the bolt hole formed inside the first shaft portion 11*a* or the second shaft portion 12*a* in the raised shape is limited to a small diameter, and for this reason, it is difficult to use a bolt with a great outer diameter. On the other hand, in the present disclosure, the outer diameter of one of the first shaft portion 11*a* or the second shaft portion 12*a* does not need to be smaller than that of the other one of the first shaft portion 11*a* or the second shaft portion 12*a*. Thus, the bolt 13 with a sufficiently-large outer diameter can be used, and the strength of the entirety of the attachment pin assembly 10 can be enhanced.

Further, in a state in which the first pin body 11 and the second pin body 12 are fastened and fixed with the bolt 13, the head 13*b* of the bolt 13 is housed in the housing recessed portion 11*c* of the first pin body 11 inside the first through-hole 2*b* so that protrusion of the head 13*b* of the bolt 13 from an end portion of the first pin body 11 (i.e., an end surface of the first flange portion 11*b*) to a lateral side can be prevented. Further, the periphery of the head 13*b* of the bolt 13 is covered with the first flange portion 11*b* in the housing recessed portion 11*c*, and therefore, the head 13*b* of the bolt 13 can be properly protected in the housing recessed portion 11*c* from an external impact upon use of the tooth 2, such as a rock or a rubble. Thus, a loss of the head 13*b* of the bolt 13 can be prevented, and dropping of the tooth 2 from the adaptor 3 can be prevented.

Further, it is configured such that the head 13*b* of the bolt 13 is housed in the housing recessed portion 11*c* of the first pin body 11 inside the first through-hole 2*b*, and therefore, the tooth 2 does not need to be thickly formed in a longitudinal direction of the first pin body 11 for the purpose of protecting the head 13*b* of the bolt 13. Thus, an increase in the weight of the tooth 2 can be properly suppressed.

Particularly in the present embodiment, the bottom surface T of the housing recessed portion 11*c* is arranged inward (i.e., the left side as viewed in FIG. 9) of the seating surface Z of the first flange portion 11*b* in an axial direction of the attachment pin assembly 10 as illustrated in FIG. 9, and therefore, the thickness A of the first flange portion 11*b* is smaller than the depth B of the housing recessed portion 11*c* by the distance C between the bottom surface T of the housing recessed portion 11*c* and the seating surface Z of the housing recessed portion 11*c* (A=B−C). Thus, the thickness of the side portion of the tooth 2 can be more effectively decreased. As described above, in the present embodiment, the housing recessed portion 11*c* is provided at the first pin body 11 so that not only the head 13*b* of the bolt 13 can be protected, but also the thickness of the side portion of the tooth 2 can be decreased to properly suppress an increase in the weight of the tooth 2.

In addition, it is configured such that the bolt 13 is screwed into the second pin body 12 without being screwed into the first pin body 11, and therefore, the first pin body 11 and the second pin body 12 can be fastened and fixed in a state in which the bolt 13 is screwed into the second pin body and the shaft 13*a* is slightly stretched. Thus, the bolt 13 can be less detached from the first pin body 11 and the second pin body 12.

Moreover, the attachment pin assembly 10 of the first embodiment includes three components of the first pin body 11, the second pin body 12, and the bolt 13. Thus, a configuration with a relatively-smaller number of components can be provided. Further, the attachment pin assembly 10 of the first embodiment also has an advantage that the attachment pin assembly 10 can be attached/detached to/from the tooth 2 and the adaptor 3 only with a single type of tool such as the hexagonal wrench.

Second Embodiment

Figure 10:
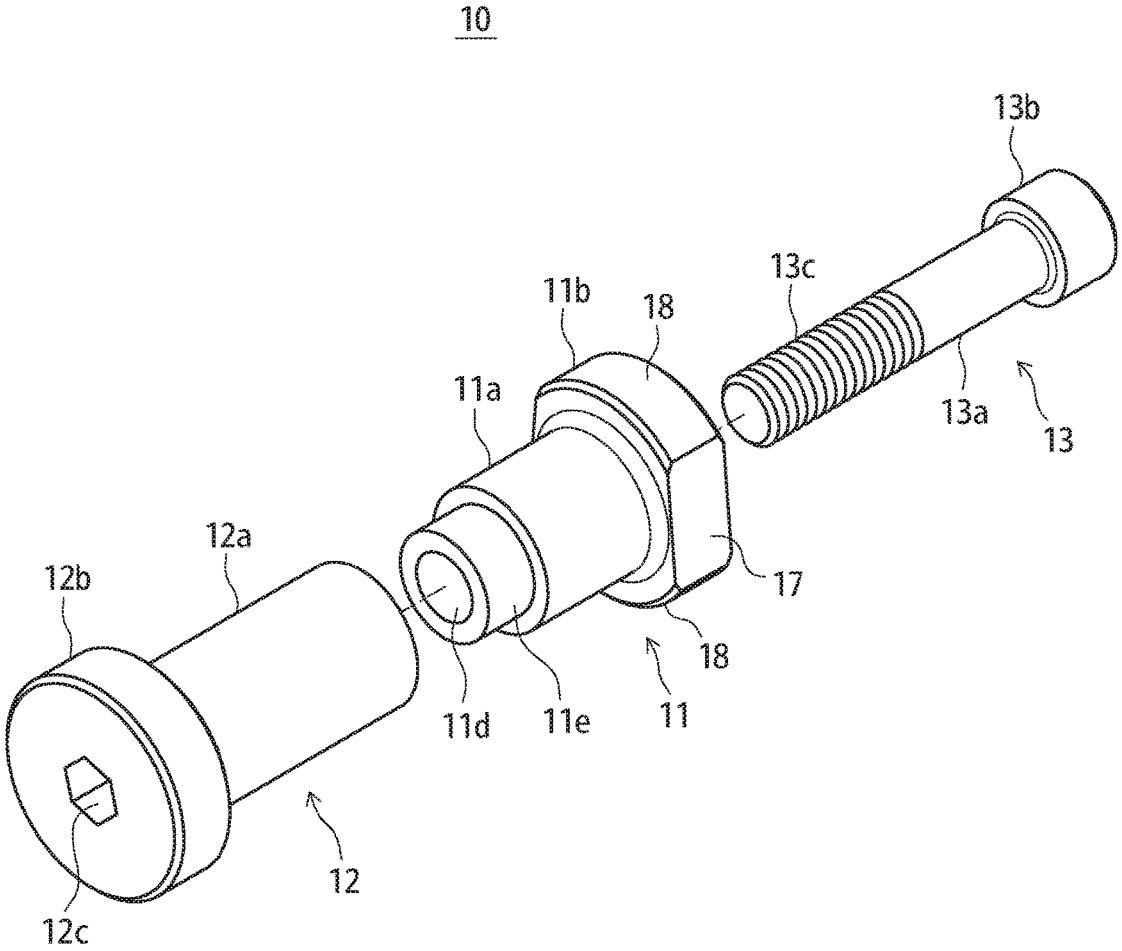
FIG. 10 is an exploded perspective view of a structure of an attachment pin assembly in a second embodiment.
Figure 11:
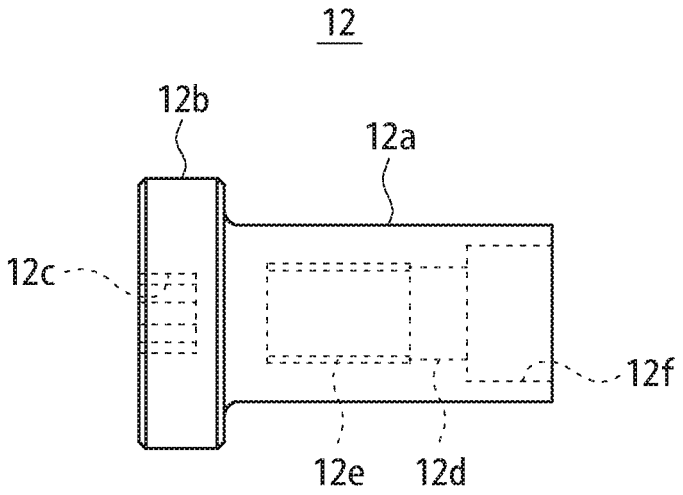
FIG. 11 is a front view of a second pin body in the second embodiment.
Figure 12:
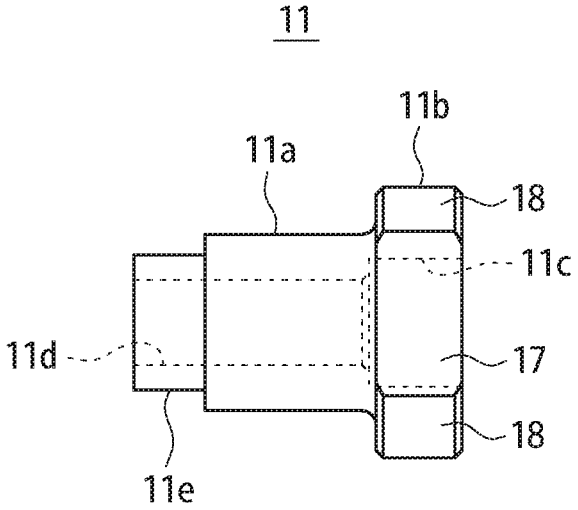
FIG. 12 is a front view of a first pin body in the second embodiment.

FIGS. 10 to 12 illustrate a second embodiment. FIGS. 10 to 12 illustrate an attachment pin assembly 10 in the second embodiment.

As illustrated in FIGS. 5 and 10, the attachment pin assembly 10 of the second embodiment has the same configuration of a bolt 13 as that of the attachment pin assembly 10 of the first embodiment, but has different configurations of a first pin body 11 and a second pin body 12. Hereinafter, these differences will be described.

As illustrated in FIG. 10 and the 12, the first pin body 11 has a circular columnar first shaft portion 11*a* and a plate-shaped first flange portion 11*b* formed at an end of the first shaft portion 11*a*. As in the second flange portion 12*b* in the first embodiment, the first flange portion 11*b* is formed in a plate shape, and includes, as side surfaces, two flat surfaces 17 extending obliquely and two arc surfaces 18 connecting these two flat surfaces 17. Moreover, a housing recessed portion 11*c* for housing a head 13*b* of the bolt 13 is formed at the first flange portion 11*b*.

A boss portion 11*e* is formed at a tip end of the first shaft portion 11*a*. The boss portion 11*e* is formed in a cylindrical shape whose outer diameter is smaller than that of the first shaft portion 11*a*. The boss portion 11*e* is arranged concentrically with respect to the first shaft portion 11*a*. A first bolt hole 11*d* is formed to penetrate the boss portion 11*e* and communicate with the housing recessed portion 11*c* of the first shaft portion 11*a*.

As illustrated in FIGS. 10 and 11, the second pin body 12 has a circular columnar second shaft portion 12*a* and a second flange portion 12*b* formed at an end of the second shaft portion 12*a*. As in the first flange portion 11*b* in the first embodiment, the second flange portion 12*b* is formed in a discoid shape, and is provided with a hexagonal hole 12*c*.

A fitting portion 12*f* to be fitted onto the boss portion 11*e* is formed at a tip end of the second shaft portion 12*a*. Moreover, a second bolt hole 12*d* extending in an axial direction of the second shaft portion 12*a* and communicating with the fitting portion 12*f* is formed at the second shaft portion 12*a*. An internal thread portion 12*e* into which an external thread portion 13*c* of the bolt 13 is to be screwed is formed at a far-side portion of the second bolt hole 12*d*.

Unlike the first embodiment, in the case of attaching and fixing a tooth 2 to an adaptor 3 of an operating machine, the first pin body 11 is inserted into a first through-hole 2*b* and a second through-hole 3*b* from a second side portion 6 of the tooth 2 in a state in which the tooth 2 is attached to the adaptor 3. Further, the second pin body 12 is inserted into a first through-hole 2*b* and the second through-hole 3*b* from a first side portion 5 of the tooth 2.

At this point, in a state in which the boss portion 11*e* of the first pin body 11 is fitted in the fitting portion 12*f* of the second pin body 12, the first shaft portion 11*a* and the second shaft portion 12*a* are housed in the second through-hole 3*b*. The first flange portion 11*b* of the first pin body 11 and the second flange portion 12*b* of the second pin body 12 are housed in the first through-holes 2*b*.

Subsequently, a shaft 13*a* of the bolt 13 is inserted into the first bolt hole 11*d* of the first pin body 11, and is screwed by a hexagonal wrench (not shown) inserted into a hexagonal hole 13*d*. At this point, the bolt 13 is screwed in a state in which the hexagonal wrench is inserted and fixed into the hexagonal hole 12*c* provided at the second flange portion 12*b*. Accordingly, the external thread portion 13*c* of the bolt 13 is screwed into the internal thread portion 12*e* of the second pin body 12. In this manner, the tooth 2 is attached and fixed to the adaptor 3.

Thus, according to the second embodiment, it is, as in the first embodiment, configured such that the head 13*b* of the bolt 13 is housed in the housing recessed portion 11*c* of the first pin body 11 inside the first through-hole 2*b*. Thus, the head 13*b* of the bolt 13 can be properly protected in the housing recessed portion 11*c* from an external impact upon use of the tooth 2, such as a rock or a rubble. Consequently, a loss of the head 13*b* of the bolt 13 can be prevented, and dropping of the tooth 2 from the adaptor 3 can be prevented.

Further, the tooth 2 does not need to be thickly formed in a longitudinal direction of the first pin body 11 for the purpose of protecting the head 13*b* of the bolt 13. Thus, an increase in the weight of the tooth 2 can be properly suppressed. Moreover, it is configured such that the bolt 13 is screwed into the second pin body 12 without being screwed into the first pin body 11, and therefore, the bolt 13 can be less detached from the first pin body 11 and the second pin body 12.

In addition, it is configured such that the boss portion 11*e* of the first pin body 11 is fitted in the fitting portion 12*f* of the second pin body 12 in a coupling state of the first pin body 11 and the second pin body 12, and therefore, the strength of the entirety of the attachment pin assembly 10 against bending can be enhanced.

Note that it may be configured such that the boss portion 11*e* is provided at the second pin body 12 and the fitting portion 12*f* is provided at the first pin body 11. That is, the boss portion 11*e* is formed at a tip end of one of the first pin body 11 or the second pin body 12, and the fitting portion 12*f* is formed at a tip end of the other one of the first pin body 11 or the second pin body 12.

Moreover, as in the first embodiment, the first flange portion 11*b* may be formed in a discoid shape. Moreover, the second flange portion 12*b* may be formed in a plate shape, and may include, as side surfaces, two flat surfaces 15 formed extending obliquely and two arc surfaces 16 connecting these two flat surfaces 15.

Further, the external thread portion 13*c* may be formed across the entirety of the shaft 13*a* of the bolt 13, and the internal thread portion may be formed at both of the first bolt hole 11*d* of the first pin body 11 and the second bolt hole 12*d* of the second pin body 12. In this case, even when the head 13*b* of the bolt 13 is lost, the hexagonal hole 12*c* is formed at the second flange portion 12*b* of the second pin body 12, and therefore, by rotation of the second pin body 12 with the hexagonal wrench, the second pin body 12 can be detached from the bolt 13 to easily detach the tooth 2 from the adaptor 3.

Third Embodiment

Figure 13:
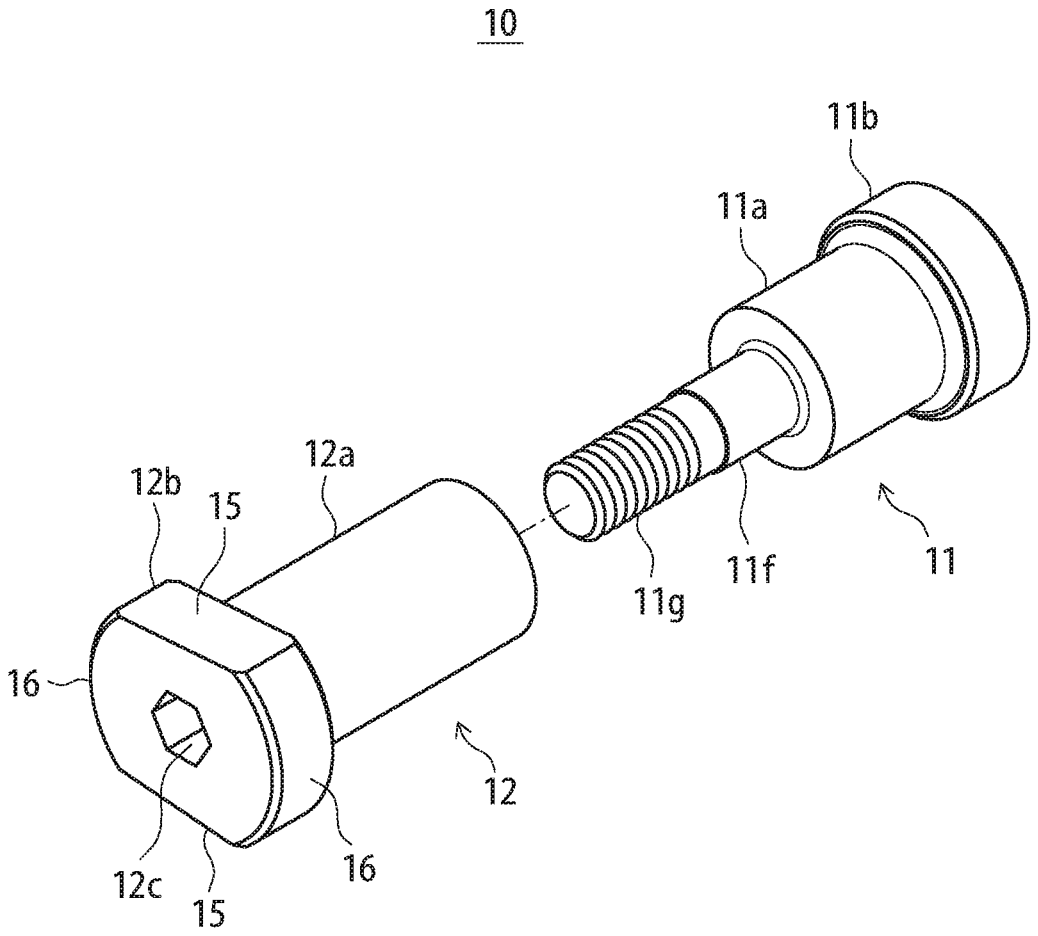
FIG. 13 is an exploded perspective view of a structure of an attachment pin assembly in a third embodiment.
Figure 14:
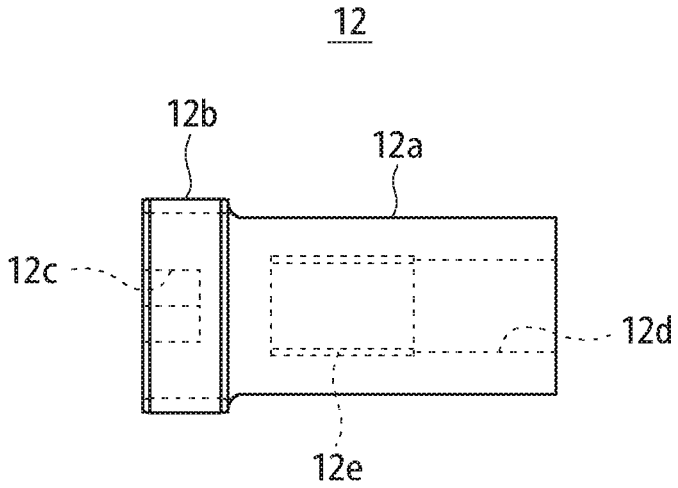
FIG. 14 is a front view of a second pin body in the third embodiment.
Figure 15:
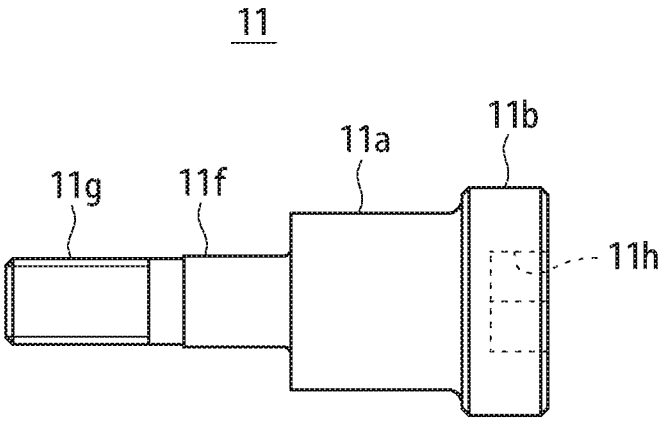
FIG. 15 is a front view of a first pin body in the third embodiment.

FIGS. 13 to 15 illustrate a third embodiment. FIGS. 13 to 15 illustrate an attachment pin assembly 10 in the third embodiment.

As illustrated in FIGS. 5 and 13, the attachment pin assembly 10 of the third embodiment is configured such that a bolt 13 and a first pin body 11 are integrally formed in the attachment pin assembly 10 of the first embodiment. A configuration of a second pin body 12 of the third embodiment is the same as that of the second pin body 12 of the first embodiment, and therefore, overlapping description will be omitted.

The attachment pin assembly 10 includes the first pin body 11 and the second pin body 12. The first pin body 11 and the second pin body 12 are each made of metal.

As illustrated in FIG. 13, the first pin body 11 has a circular columnar first shaft portion 11*a*, a discoid first flange portion 11*b* formed at an end of the first shaft portion 11*a*, and a bolt shaft portion 11*f* formed on the opposite side of the first flange portion 11*b* of the first shaft portion 11*a*. The bolt shaft portion 11*f* extends in an axial direction of the first shaft portion 11*a*, and an external thread portion 11*g* is formed at a portion extending from a substantially center position to a tip end of the bolt shaft portion 11*f*. A hexagonal hole 11*h* is formed at the center of the first flange portion 11*b*.

The second pin body 12 has a circular columnar second shaft portion 12*a* and a plate-shaped second flange portion 12*b* formed at an end of the second shaft portion 12*a*. A second bolt hole 12*d* extending in an axial direction of the second shaft portion 12*a* is formed at the second shaft portion 12*a*. An internal thread portion 12*e* into which the external thread portion 11*g* of the bolt shaft portion 11*f* is to be screwed is formed at a far-side portion of the second bolt hole 12*d*.

In the case of attaching and fixing a tooth 2 to an adaptor 3 of an operating machine, the second pin body 12 is inserted into a first through-hole 2*b* and a second through-hole 3*b* from a second side portion 6 of the tooth 2 in a state in which the tooth 2 is attached to the adaptor 3. Further, the first pin body 11 is inserted into a first through-hole 2*b* and the second through-hole 3*b* from a first side portion 5 of the tooth 2. At this point, the bolt shaft portion 11*f* of the first pin body 11 is inserted into the second bolt hole 12*d* of the second pin body 12. Further, the bolt shaft portion 11*f* is screwed into the second bolt hole 12*d* by a hexagonal wrench (not shown) inserted into the hexagonal hole 11*h*, and accordingly, the external thread portion 11*g* of the bolt shaft portion 11*f* is screwed into the internal thread portion 12*e* of the second bolt hole 12*d*.

At this point, the second flange portion 12*b* including, as side surfaces, two flat surfaces 15 and two arc surfaces 16 is locked at an inner wall surface of the tooth 2 forming the first through-hole 2*b*. Thus, when the bolt shaft portion 11*f* is screwed into the second bolt hole 12*d*, the second flange portion 12*b* functions as a rotation stopper of the second pin body 12.

As described above, in a state in which the attachment pin assembly 10 is attached to the tooth 2 and the adaptor 3, the first shaft portion 11*a* of the first pin body 11 and the second shaft portion 12*a* of the second pin body 12 are housed in the second through-hole 3*b*. Further, the first flange portion 11*b* and the second flange portion 12*b* are each housed in the first through-holes 2*b*.

As described above, in the third embodiment, the attachment pin assembly 10 includes the first pin body 11 and the second pin body 12, and the bolt for fastening the first pin body 11 and the second pin body 12 is integrally formed with the first pin body 11. That is, the first pin body 11 itself (i.e., the first shaft portion 11*a* and the first flange portion 11*b*) serves as a head of the bolt. Thus, the attachment pin assembly 10 of the third embodiment is configured such that the head of the bolt does not protrude from an end portion of the pin body as in a typical case. Moreover, the first shaft portion 11*a* is housed in the second through-hole 3*b*, and the first flange portion 11*b* is housed in the first through-hole 2*b*. Thus, the first shaft portion 11*a* and the first flange portion 11*b* can be protected from an external impact. Further, the first flange portion 11*b* is larger than and is more solid than a head of a typical bolt, and therefore, a loss of the first flange portion 11*b* from the bolt shaft portion 11*f* less occurs even when an impact is provided from the outside. Thus, according to the third embodiment, dropping of the tooth 2 from the adaptor 3 can be also prevented.

In addition, the tooth 2 does not need to be thickly formed in a longitudinal direction of the first pin body 11 for the purpose of protecting the head of the bolt. Thus, an increase in the weight of the tooth 2 can be properly suppressed.

Note that in the first to third embodiments, the example where the first through-hole 2*b* of one of the first side portion 5 or the second side portion 6 is in the shape different from the circular shape has been described, but the present disclosure is not limited to this example. The first through-holes 2*b* of both of the first side portion 5 and the second side portion 6 may be in the circular shape. In this case, the bolt 13 can be screwed in a state in which the hexagonal wrench is inserted and fixed into the hexagonal hole 12*c* provided at the second flange portion 12*b*.

INDUSTRIAL APPLICABILITY

As described above, the present disclosure is useful for an attachment pin assembly for attaching a drilling tool to an adaptor of an operating machine.

LIST OF REFERENCE NUMERALS

2 tooth (drilling tool)
2*b* first through-hole
3 adaptor
3*b* second through-hole
5 first side portion
6 second side portion
10 attachment pin assembly
11 first pin body

11*c* housing recessed portion
11*e* boss portion
12 second pin body
12*f* fitting portion
13 bolt

The invention claimed is:

1. An attachment pin assembly for attaching and fixing a drilling tool to an adaptor of an operating machine in a drilling tool attachment state in which the adaptor is inserted into the drilling tool in contact with the drilling tool, the drilling tool being provided with a pair of first through-holes, the adaptor being provided with a second through-hole, and the pair of first through-holes and the second through-hole being arranged to penetrate the drilling tool and the adaptor in the drilling tool attachment state, said attachment pin assembly comprising:

a first pin body including a first shaft portion inserted into one of the first through-holes and the second through-hole from a first side portion of the drilling tool and a flange portion formed at an end of the first shaft portion;

a second pin body having a second shaft portion inserted into the other first through-hole and the second through-hole from a second side portion of the drilling tool on an opposite side of the first side portion; and a bolt inserted into the flange portion and the first shaft portion of the first pin body and the second shaft portion of the second pin body to fasten and fix the first pin body and the second pin body to each other, wherein a housing recessed portion for housing a head of the bolt inside the one of the first through-holes is formed at the flange portion of the first pin body, and an inside bottom surface of the housing recessed portion is offset towards a tip end side of the first shaft portion with respect to an outside seating surface of the flange portion facing an end of the second through hole.

2. The attachment pin assembly of claim 1, wherein it is configured such that the bolt is screwed into the second pin body without being screwed into the first pin body.

* * * * *